US011253051B2

(12) United States Patent
Scalisi

(10) Patent No.: US 11,253,051 B2
(45) Date of Patent: Feb. 22, 2022

(54) PROTECTIVE CASE FOR FACE MASK

(71) Applicant: Joseph Frank Scalisi, Yorba Linda, CA (US)

(72) Inventor: Joseph Frank Scalisi, Yorba Linda, CA (US)

(73) Assignee: SAVAGE BRANDS, INC., Irvine, CA (US)

( * ) Notice: Subject to any disclaimer, the term of this patent is extended or adjusted under 35 U.S.C. 154(b) by 0 days.

(21) Appl. No.: 16/914,199

(22) Filed: Jun. 26, 2020

(65) Prior Publication Data

US 2021/0401157 A1 Dec. 30, 2021

(51) Int. Cl.
*A45F 5/02* (2006.01)
*A45C 11/00* (2006.01)

(52) U.S. Cl.
CPC ..... *A45F 5/021* (2013.01); *A45C 11/00* (2013.01); *A45C 2011/007* (2013.01)

(58) Field of Classification Search
CPC ..... A45F 5/021; A45C 11/00; A45C 11/04; A45C 11/34; A61C 2202/00
USPC ..... 206/37, 38, 234, 5, 8, 811, 83, 6, 216, 206/39.1, 478, 477, 504
See application file for complete search history.

(56) References Cited

U.S. PATENT DOCUMENTS 3,132,345 A 5/1964 Keith
3,196,458 A 7/1965 Keith
3,211,146 A 10/1965 Rodelli
3,757,777 A 9/1973 Kaufman
D229,375 S 11/1973 Beaudin
4,090,510 A 5/1978 Segersten
D277,513 S 2/1985 Parsons
D285,374 S 8/1986 Huber
4,940,068 A * 7/1990 Pokorny ..... A45C 1/06 150/132
4,957,124 A 9/1990 Mooney
5,125,531 A * 6/1992 Wentz ..... B65D 25/22 206/811
D340,317 S 10/1993 Cole
D355,393 S 2/1995 Bezener
5,423,419 A * 6/1995 Wentz ..... A45C 11/04 206/6
5,575,009 A 11/1996 Ryvin
5,704,073 A 1/1998 Sword
5,863,312 A 1/1999 Wolfe
(Continued)

OTHER PUBLICATIONS

Filters Fast—Reusable Mesh Particulate Respirator Mask Meets N95 N99 Standard—Downloaded Apr. 8, 2020 from <URL: https://www.filtersfast.com/p-RZ-Mask-M2-Black-Mesh-Mask.asp>.
(Continued)

*Primary Examiner* — Rafael A Ortiz
(74) *Attorney, Agent, or Firm* — Wesley E. Schwie, Esq.; Gallium Law

(57) ABSTRACT

A protective case may comprise a first portion, a second portion rotatably coupled to the first portion at a first point, a latching mechanism configured to detachably couple the first portion to the second portion at a second point located opposite the first point, and a cable configured to retain at least one object within an interior portion of at least one of the first portion and the second portion. The at least one object may be at least one of a protective face mask and at least one replaceable filter.

19 Claims, 12 Drawing Sheets

(56) References Cited

U.S. PATENT DOCUMENTS

| | | | | |
|---|---|---|---|---|
| 5,878,873 | A * | 3/1999 | Clark | A45C 13/1084 206/6 |
| 6,041,782 | A | 3/2000 | Angadjivand | |
| D423,726 | S | 4/2000 | Backus | |
| D429,385 | S | 8/2000 | Lee | |
| D430,361 | S | 8/2000 | Smith | |
| 6,116,236 | A | 9/2000 | Wyss | |
| 6,148,817 | A | 11/2000 | Bryant | |
| D434,879 | S | 12/2000 | Cole | |
| D440,302 | S | 4/2001 | Wolfe | |
| 6,276,414 | B1 * | 8/2001 | Bibb | A45C 1/06 150/131 |
| 6,530,373 | B1 | 3/2003 | Patron | |
| 6,729,467 | B1 * | 5/2004 | King | A45C 11/04 206/5 |
| 7,077,139 | B2 | 7/2006 | Amante | |
| 7,200,897 | B2 * | 4/2007 | Silvestro | G02C 3/04 24/3.3 |
| D604,910 | S | 11/2009 | Smaller | |
| D636,128 | S | 4/2011 | Hancock | |
| 8,066,006 | B2 | 11/2011 | Daugaard | |
| D683,447 | S | 5/2013 | Olsen | |
| D698,498 | S | 1/2014 | Fleming | |
| 9,204,951 | B2 * | 12/2015 | Brooks | A46B 15/0091 |
| 9,320,923 | B2 | 4/2016 | Koehler | |
| D767,754 | S | 9/2016 | Danford | |
| D773,121 | S | 11/2016 | Yuan | |
| 9,707,444 | B1 | 7/2017 | Danford | |
| 9,770,611 | B2 | 9/2017 | Facer | |
| D803,482 | S | 11/2017 | Greenblat | |
| D811,582 | S | 2/2018 | Moulton | |
| D812,737 | S | 3/2018 | Moulton | |
| D819,194 | S | 5/2018 | Wenger | |
| D821,568 | S | 6/2018 | Nilsson | |
| 10,065,055 | B2 | 9/2018 | Larsen | |
| D833,682 | S | 11/2018 | Greenblat | |
| D848,075 | S | 5/2019 | Szasz | |
| 10,575,583 | B2 | 3/2020 | Stephens | |
| 2002/0185134 | A1 | 12/2002 | Bishop | |
| 2004/0078860 | A1 | 4/2004 | Bell | |
| 2007/0051842 | A1 * | 3/2007 | Pryor | A45C 11/182 242/378.3 |
| 2008/0202960 | A1 * | 8/2008 | Donohue | B65D 65/02 206/362.3 |
| 2008/0223370 | A1 | 9/2008 | Kim | |
| 2009/0044809 | A1 | 2/2009 | Welchel | |
| 2009/0114550 | A1 * | 5/2009 | Ying | A45C 15/00 206/5 |
| 2010/0040655 | A1 * | 2/2010 | Ren | A41D 13/1192 424/402 |
| 2012/0167891 | A1 | 7/2012 | Smaller | |
| 2013/0118935 | A1 * | 5/2013 | Zar | A45C 11/00 206/320 |
| 2017/0100612 | A1 | 4/2017 | Conge | |
| 2017/0144000 | A1 | 5/2017 | Danford | |
| 2017/0157435 | A1 | 6/2017 | Choi | |
| 2017/0196280 | A1 | 7/2017 | Murphy | |
| 2018/0008848 | A1 | 1/2018 | Moulton | |
| 2018/0035729 | A1 | 2/2018 | Pearson | |
| 2018/0146733 | A1 | 5/2018 | Greenblat | |
| 2018/0369618 | A1 | 12/2018 | Wang | |
| 2019/0143153 | A1 | 5/2019 | Lee | |
| 2019/0143253 | A1 | 5/2019 | Lee | |
| 2019/0358473 | A1 | 5/2019 | Lee | |

OTHER PUBLICATIONS

GIR—Reusable Face Mask—Downloaded Apr. 8, 2020 from <URL: https://gir.co/products/mask-kit?variant=31569419665497>.

* cited by examiner

PROTECTIVE CASE FOR FACE MASK

BACKGROUND

Field

Various embodiments disclosed herein relate to protective cases for face masks. Certain embodiments relate to protective cases for face masks including mechanisms for retaining the face mask within the case.

Description of Related Art

Protective face masks can prevent the spread of illness by providing a barrier between the external environment and a mouth and nose of a user. Protective face masks may also filter the air breathed by the user. Protective face masks often cover the lower portion of the user's face and are secured with a strap(s) and/or tie(s). The strap(s) and/or tie(s) may go around a user's head, or may secure around the user's ears. Protective face masks may be worn by healthcare workers, anyone working in an environment with large amounts of particulate matter in the air (e.g., firefighters, construction workers, etc.), and anyone in the general public who desires protection from pollution and/or illness.

When not in use, face masks may be at risk of getting dirty and/or damaged. Protective cases can hold face masks to prevent the accumulation of bacteria, pocket lint, and other elements of the surrounding environment, and help to reduce the chance of face masks getting damaged when not being worn. Protective cases may include hard shell-like exteriors or soft exteriors. Protective cases can have a variety of mechanisms for closing each case and retaining the face mask(s) within.

SUMMARY

The disclosure includes a protective case, which, in some embodiments, includes a first portion, a second portion rotatably coupled to the first portion at a first point, a latching mechanism configured to detachably couple the first portion to the second portion at a second point located opposite the first point, and a cable configured to retain at least one object within an interior portion of at least one of the first portion and the second portion. The protective case may further comprise a plurality of gangways located on the interior portion of at least one of the first portion and the second portion, wherein the gangways may be configured to couple the cable to at least one of the first portion and the second portion.

In some embodiments, the protective case includes a belt clip located on a back portion of the second portion, wherein the belt clip is configured to receive at least one of a belt and a waistband to thereby enable a user to wear the protective case. The belt clip may comprise a plurality of tooth-like projections located on an interior portion of the belt clip such that when the belt clip receives at least one of the belt and the waistband, the tooth-like projections are configured to contact a surface of the at least one of the belt and the waistband that is opposite a surface of the at least one of the belt and the waistband located adjacent the back portion of the second portion. In some embodiments, the protective case further comprises a belt loop located on a back portion of the second portion, wherein the belt loop is configured to receive a belt to thereby couple the protective case to the belt.

The first portion of the protective case may comprise a channel located adjacent an outer edge of the first portion, the channel configured to receive an outer edge of the second portion. In some embodiments, when the channel of the first portion receives the outer edge of the second portion, a seal is created between the first portion and the second portion. The seal may comprise a seal that is substantially waterproof.

In many embodiments, at least one of the first portion and the second portion comprise a material configured to impart at least one of anti-bacterial, anti-viral, and anti-fungal properties to the protective case. The material may comprise silver nanoparticles. In some embodiments, the cable comprises a material that is configured to stretch. The cable may further comprise a material configured to impart at least one of anti-bacterial, anti-viral, and anti-fungal properties to the cable. The material may comprise silver nanoparticles.

In some embodiments, the first portion defines a first depth and the second portion defines a second depth, wherein the first depth is greater than the second depth. The second depth may comprise a tapered depth such that a depth adjacent the first point is less than a depth adjacent the second point.

In many embodiments, the first portion couples to the second portion at the first point via a hinge. The latching mechanism may comprise a draw latch. In some embodiments, the draw latch comprises a loop and a retaining tab, wherein the loop is coupled to the first portion and the retaining tab is coupled to the second portion.

The at least one object may comprise at least one of a protective face mask and at least one replaceable filter. In some embodiments, the first portion is configured to retain the protective face mask and the second portion is configured to retain the at least one replaceable filter.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

COMPONENT INDEX

Figure 1:
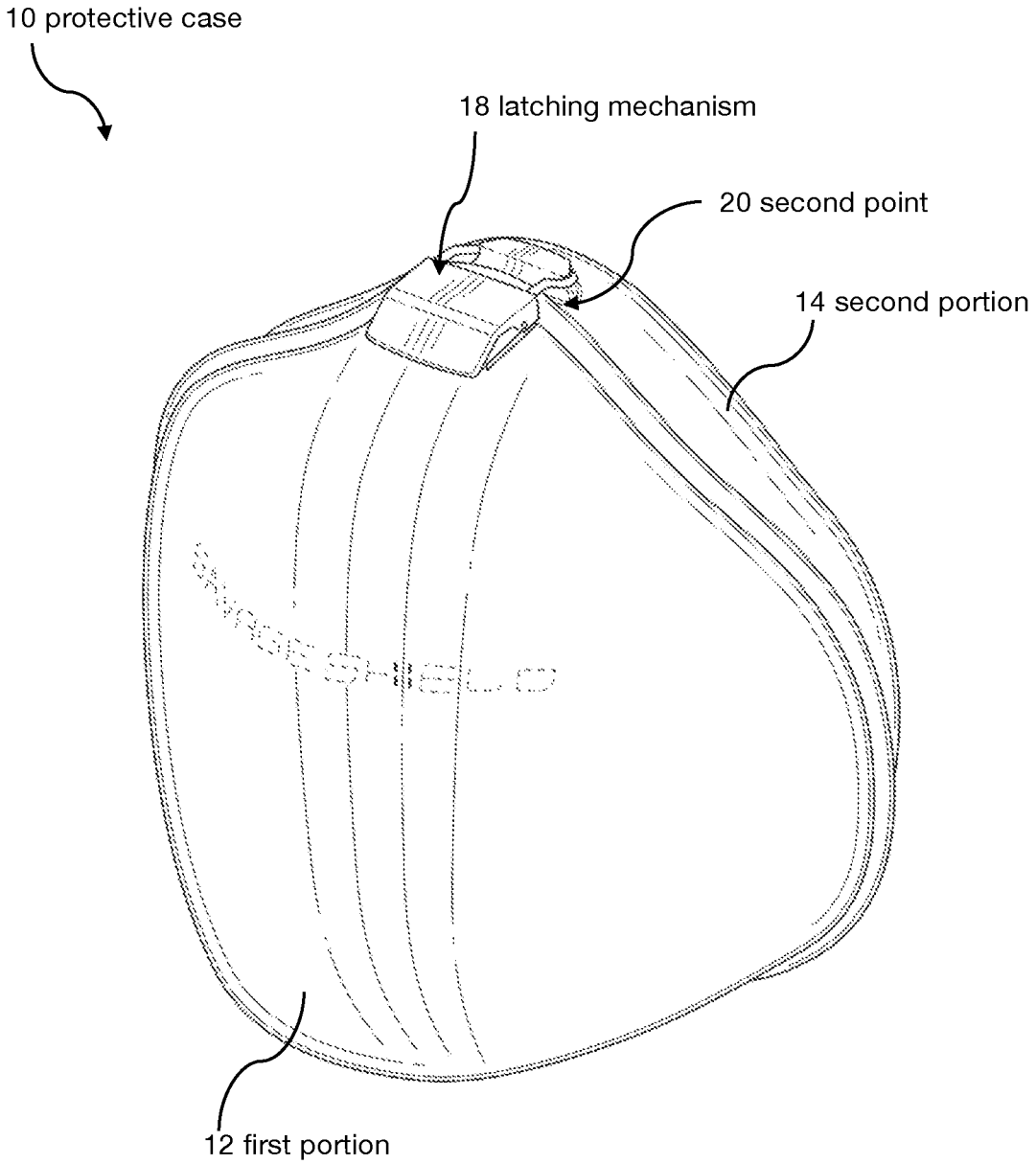
FIG. 1 illustrates a front perspective view of a protective case, according to some embodiments.

10—protective case
12—first portion
14—second portion
16—first point
18—latching mechanism
20—second point
22—cable
24—at least one object
26—interior portion (of first/second portion)
28—plurality of gangways
30—belt clip
32—back portion (of second portion)
34—plurality of tooth-like projections
36—interior portion (of belt clip)
38—belt loop
40—channel
**42*a***—outer edge (of first portion)
**42*b***—outer edge (of second portion)
44—first depth
46—second depth
**46*a***—second depth adjacent first point
**46*b***—second depth adjacent second point
48—hinge
50—draw latch
**50*a***—loop
**50*b***—retaining tab
52—protective face mask
54—at least one replaceable filter FIG. 1 shows a front perspective view of a protective case 10. In some embodiments, the protective case 10 includes a first portion 12 and a second portion 14. The first portion 12 may be referred to as the front of the case 10, and the second portion 14 as the back of the case 10. The first portion 12 and second portion 14 may be detachably coupled via a latching mechanism 18 at a second point 20. The latching mechanism 18 may be any suitable type of mechanism, including but not limited to, any clasp, snap, button, zipper, and/or the like. Further details of the latching mechanism 18 shown in FIG. 1 will be discussed later in the disclosure, in particular with reference to FIG. 7.

Figure 2:
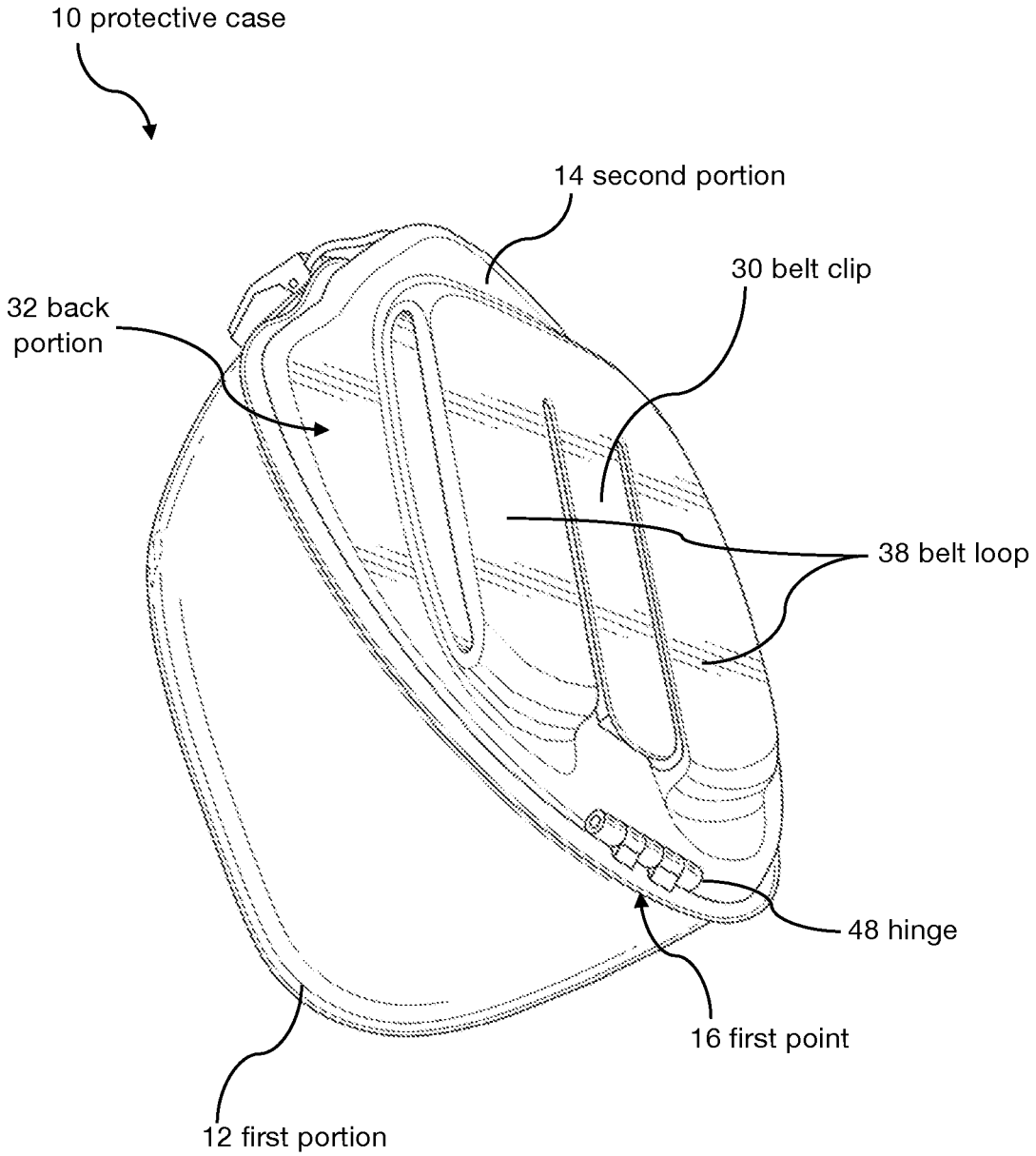
FIG. 2 illustrates a back perspective view of a protective case, according to some embodiments.

FIG. 2 illustrates a back perspective view of the protective case 10. As shown, in addition to the latching mechanism 18 at the second point 20, the first portion 12 and the second portion 14 may be coupled at a first point 16. In many embodiments, the first portion 12 and the second portion 14 are coupled at the first point 16 via a hinge 48. Similar to the latching mechanism 18, any suitable mechanism may be used to couple the first portion 12 and the second portion 14 at the first point 16, including, but not limited to, any clasp, snap, button, zipper, and/or the like. In some embodiments, the first portion 12 is fixedly coupled to the second portion 14 at the first point 16. The first portion 12 may be detachably coupled to the second portion 14 at the first point 16. In many embodiments, and as demonstrated in FIG. 2 via the hinge 48, the first portion 12 is rotatably coupled to the second portion 14 at the first point 16.

FIG. 2 also shows that, in some embodiments, a back portion 32 of the second portion 14 includes a belt clip 30 and a belt loop 38. The belt clip 30 may be configured to receive at least one of a belt and a waistband to thereby enable a user to wear the protective case 10. The belt clip 30 may also be configured to receive other garments and/or accessories, such as a pocket, a purse, a backpack, a lanyard, military web gear, and/or the like. The belt loop 38 may also be configured to receive a belt to thereby couple the protective case 10 to the belt. In some embodiments, the belt loop 38 is configured to receive a belt through the belt loop 38, whereas the belt clip 30 is configured to receive a belt (or waistband, pocket, or the like) from a bottom portion of the belt clip 30. The belt clip 30 may be configured to flex outward from the back portion 32 of the second portion 14 in order to receive the belt or other garment. In some embodiments, the belt clip 30 is located substantially in the middle of the belt loop 38 such that when the belt loop 38 is in use, the belt clip 30 is also in contact with the belt threaded through the belt loop 38.

Figure 3:
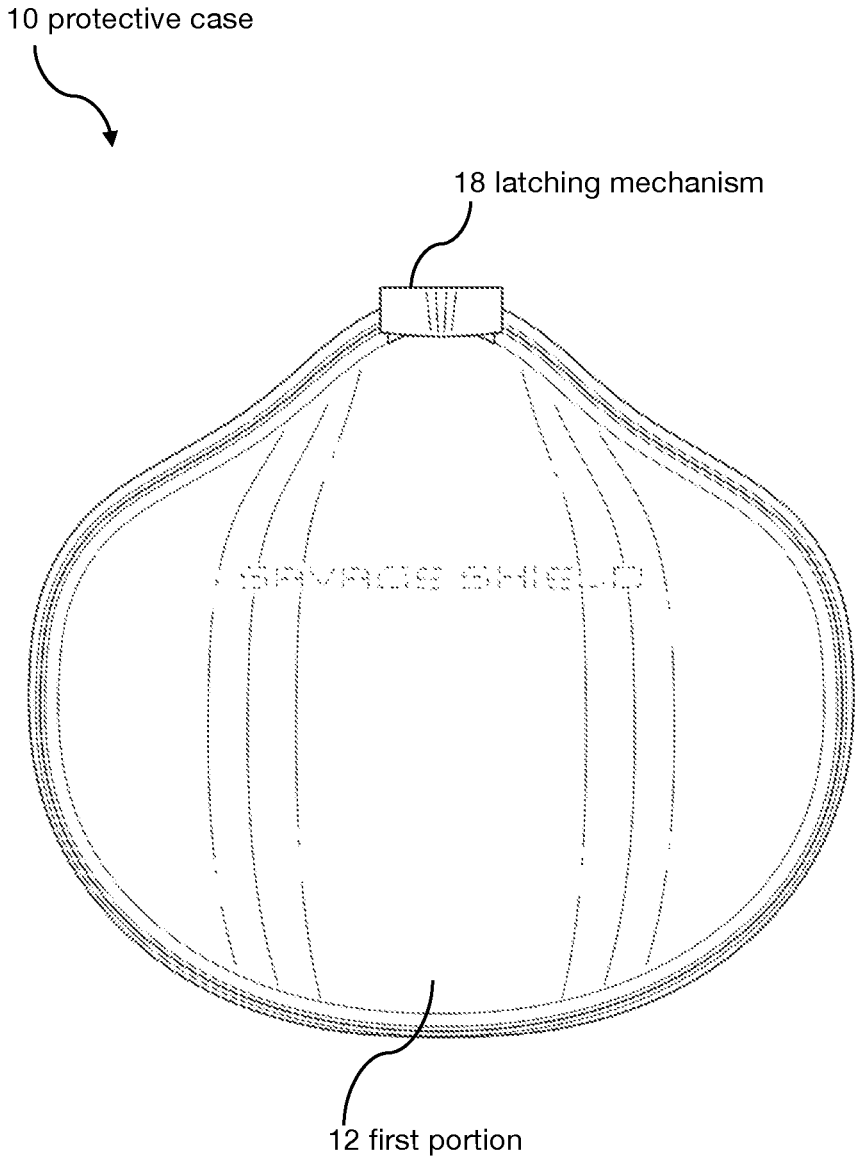
FIG. 3 illustrates a front view of a protective case, according to some embodiments.

FIG. 3 illustrates a front view of the protective case 10, including the first portion 12 and the latching mechanism 18. As shown in FIG. 3, the protective case 10 may define a generally ovoid shape with an upward protrusion on the top of the case 10, adjacent the latching mechanism 18. In some embodiments, this shape enables the protective case 10 to fit face masks with a dedicated portion designed to fit over a user's nose. For example, the protective case 10 may fit the Savage Shield Mask Professional, sold by Savage Shield of Irvine, Calif. The protective case 10 may also fit any other face mask produced by Savage Shield or any other company. The protective case 10 may comprise generally smooth curves and no harsh edges anywhere along the shape of the case 10.

Figure 4:
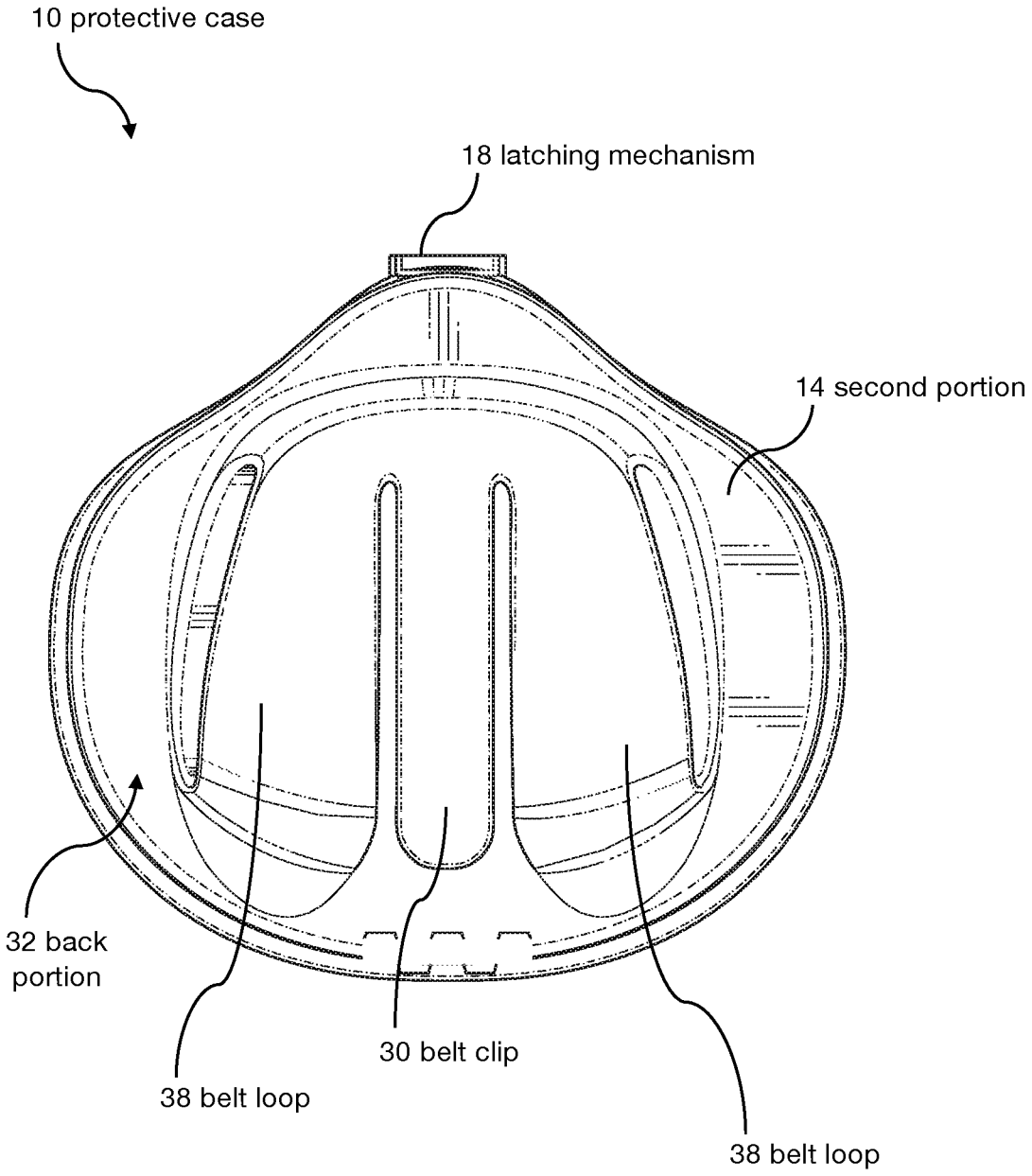
FIG. 4 illustrates a back view of a protective case, according to some embodiments.
Figure 5:
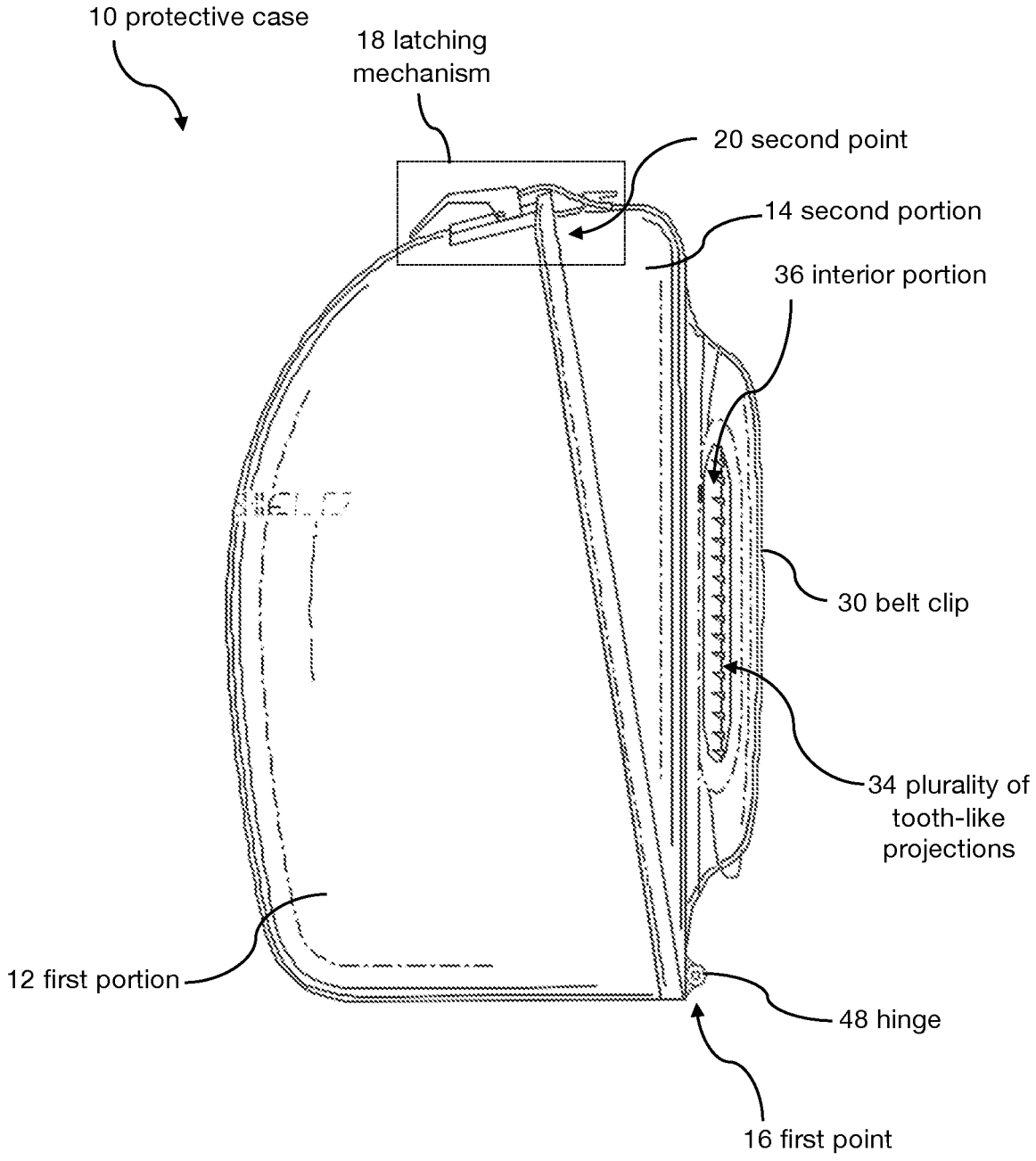
FIGS. 5 and 6 illustrate side views of a protective case, according to some embodiments.

FIG. 4 shows a back view of the protective case 10 and, similar to FIG. 2, includes the back portion 32 of the second portion 14. As previously discussed, in some embodiments, the back portion 32 includes a belt loop 38 and a belt clip 30. As shown in FIG. 5, the belt clip 30 may include a plurality of tooth-like projections 34 on an interior portion 36 of the belt clip 30. In some embodiments, the plurality of tooth-like projections 34 are configured to help facilitate the belt clip 30 receiving a belt, waistband, etc. by providing friction between the protective case 10 and the belt, waistband, etc. In addition to the belt clip 30, the belt loop 38 may also include a plurality of tooth-like projections 34. In some embodiments, the plurality of tooth-like projections 34 are located such that when the belt clip 30 and/or belt loop 38 receives a belt, for example, the plurality of tooth-like projections 34 are configured to contact a surface of the belt that is opposite a surface of the belt located adjacent the back portion 32 of the second portion 14. Stated differently, the plurality of tooth-like projections 34 may be configured to contact a "front" or "outside" surface of a belt, and the "back" or "inside" surface of the belt may be located adjacent the back portion 32 of the second portion 14.

Figure 6:
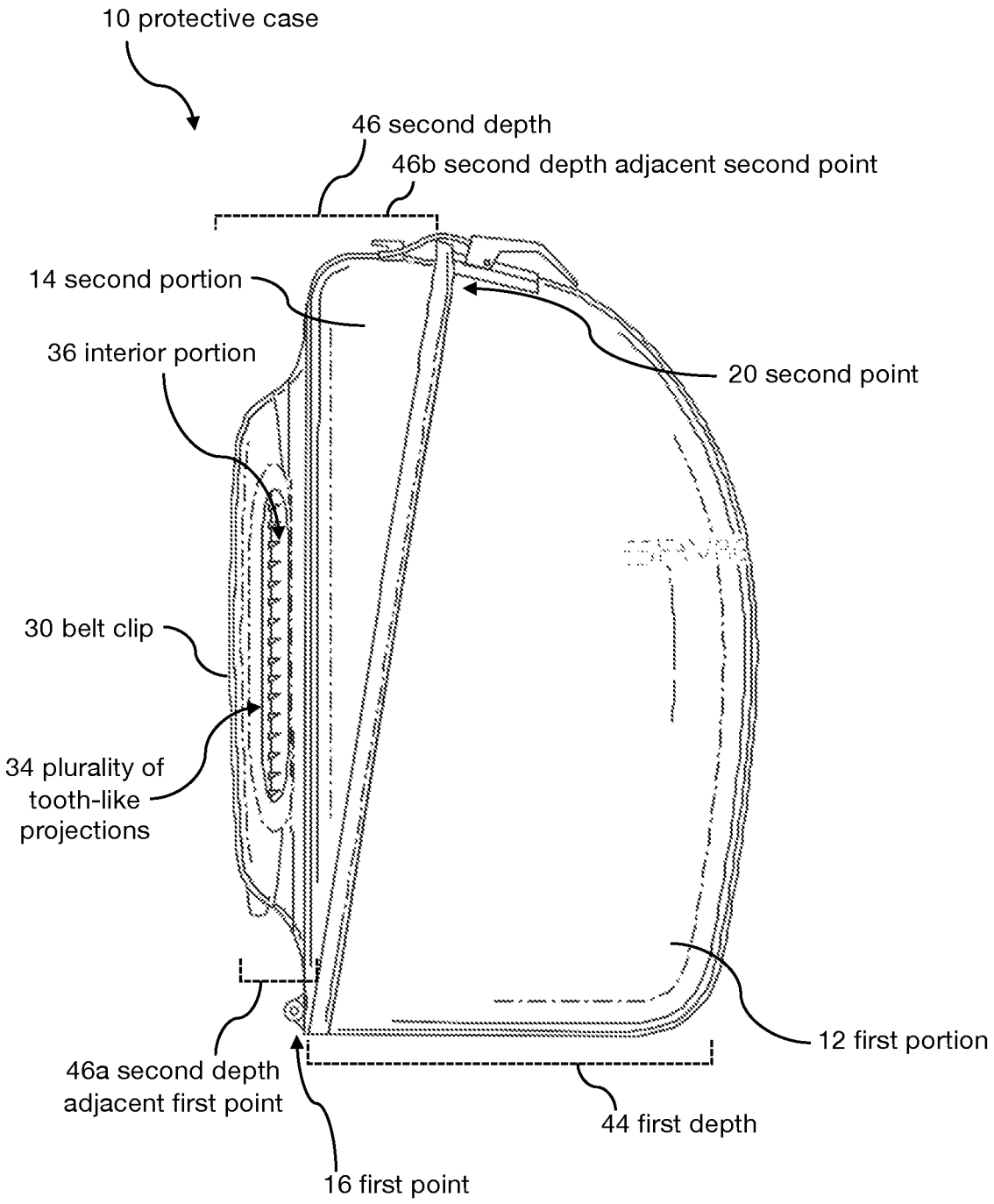

FIG. 6 is another side view of the protective case 10. As shown in FIG. 6, in some embodiments, the first portion 12 defines a first depth 44 and the second portion 14 defines a second depth 46, which is less than the first depth 44. The first depth 44 may be less than the second depth 46. The second depth 46 may define a tapered depth comprising a second depth adjacent the first point 46*a* and a second depth adjacent the second point 46*b*. As demonstrated by FIG. 6, in some embodiments, the second depth adjacent the first point 46*a* is less than the second depth adjacent the second point 46*b*. The second depth adjacent the first point 46*a* may be greater than the second depth adjacent the second point 46*b*. In some embodiments, the second depth 46 does not define a tapered depth. The first depth 44 may define a tapered depth. The first depth 44 may define a varying depth such that the deepest point of the first portion 12 is located near the middle of the first portion 12. The first depth 44 may be about 69 mm, and the depth of the whole protective case 10 may be about 82 mm. In some embodiments, the second depth adjacent the first point 46*a* is about 5.5 mm and the second depth adjacent the second point 46*b* is about 21 mm.

Figure 7:
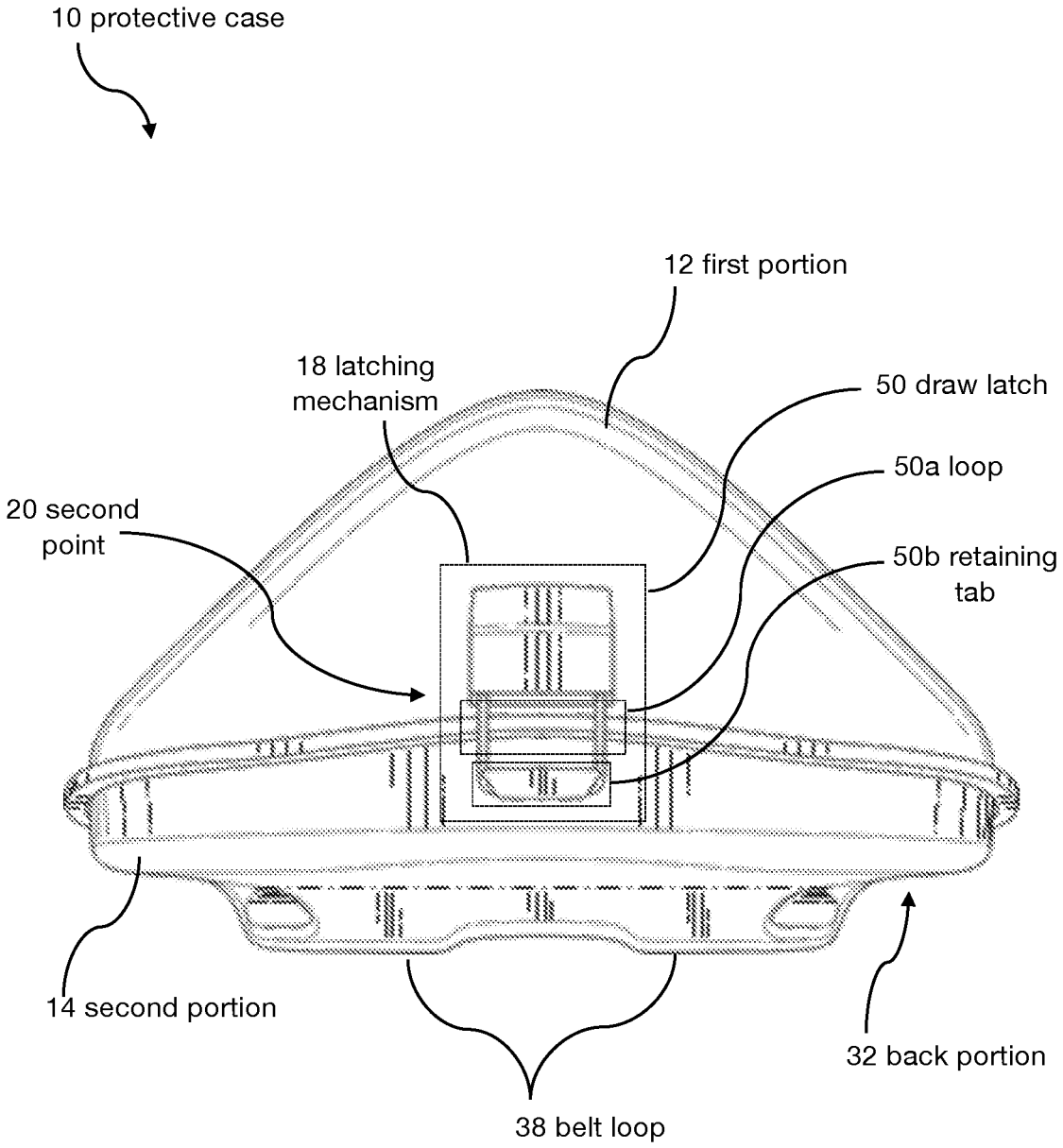
FIG. 7 illustrates a top view of a protective case, according to some embodiments.

FIG. 7 shows a top view of the protective case 10, and includes more details of the latching mechanism 18 located at the second point 20. As illustrated, in some embodiments, the latching mechanism 18 comprises a draw latch 50. The draw latch 50 may include a loop 50*a* and a retaining tab 50*b*, where the loop 50*a* is configured to loop around the retaining tab 50*b*, and thereby couple the loop 50*a* to the retaining tab 50*b*. In some embodiments, the loop 50*a* is coupled to the first portion 12 and the retaining tab 50*b* is coupled to the second portion 14. As such, the coupling of the loop 50*a* and the retaining tab 50*b* is configured to thereby couple the first portion 12 and the second portion 14. In some embodiments, the draw latch 50 is a military-grade draw latch. As previously discussed, the latching mechanism 18 may comprise a different type of mechanism than a draw latch 50. When the latching mechanism 18 comprises a different type of mechanism, there may be at least two components to the mechanism, wherein one component couples to the first portion 12 and another component couples to the second portion 14.

Figure 8:
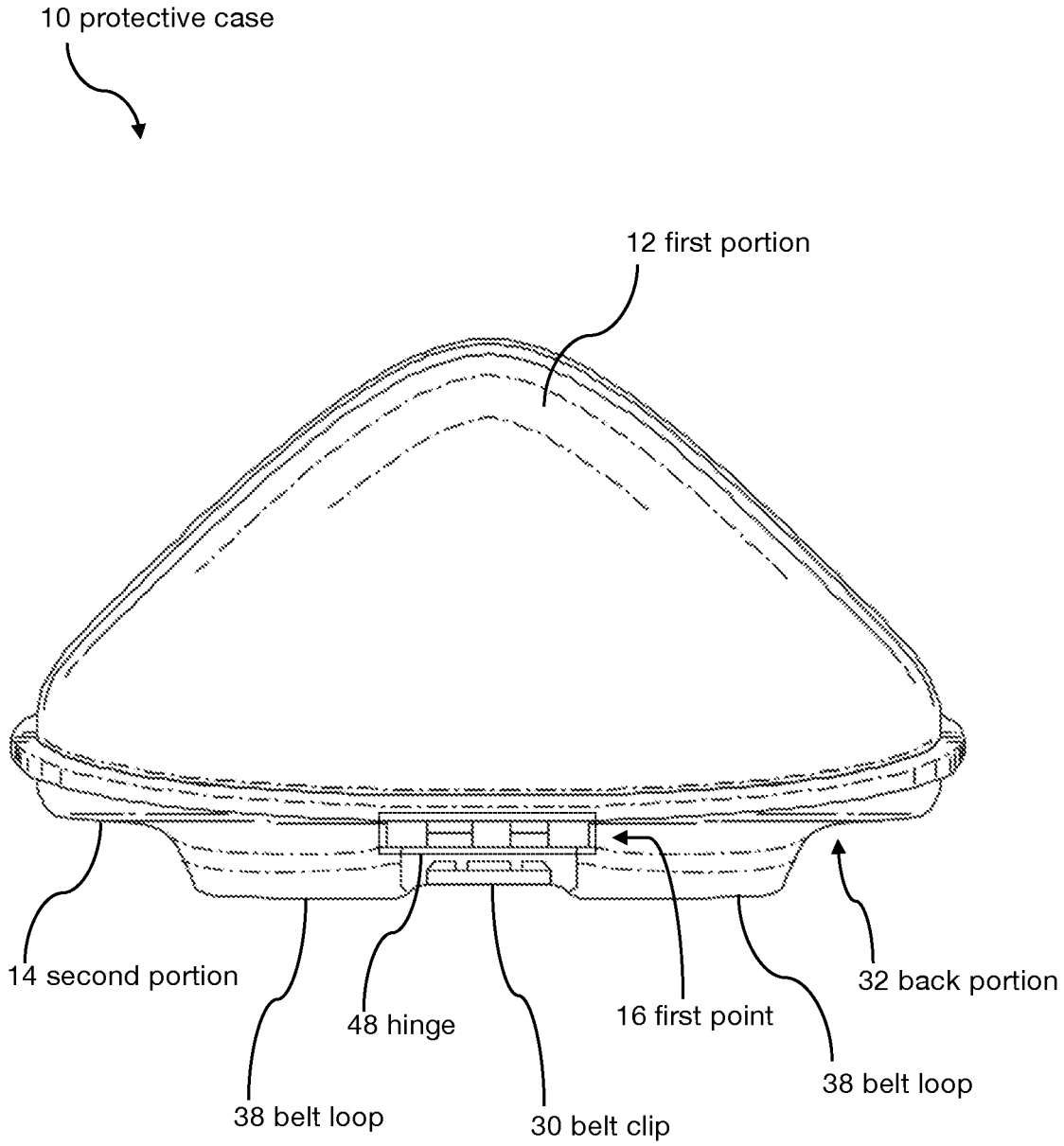
FIG. 8 illustrates a bottom view of a protective case, according to some embodiments.

FIG. 8 illustrates a bottom view of the protective case 10, and shows the hinge 48 at the first point 16. As previously stated, a mechanism other than a hinge 48 may be used to rotatably couple the first portion 12 to the second portion 14 at the first point 16. FIG. 8 also includes a bottom view of the belt clip 30 and the belt loop 38. As shown in FIG. 2, the belt clip 30 may have a length that is substantially the same length as the belt loop 38. In some embodiments, the belt clip 30 is shorter than the belt loop 38. The belt clip 30 may be longer than the belt loop 38.

Figure 9:
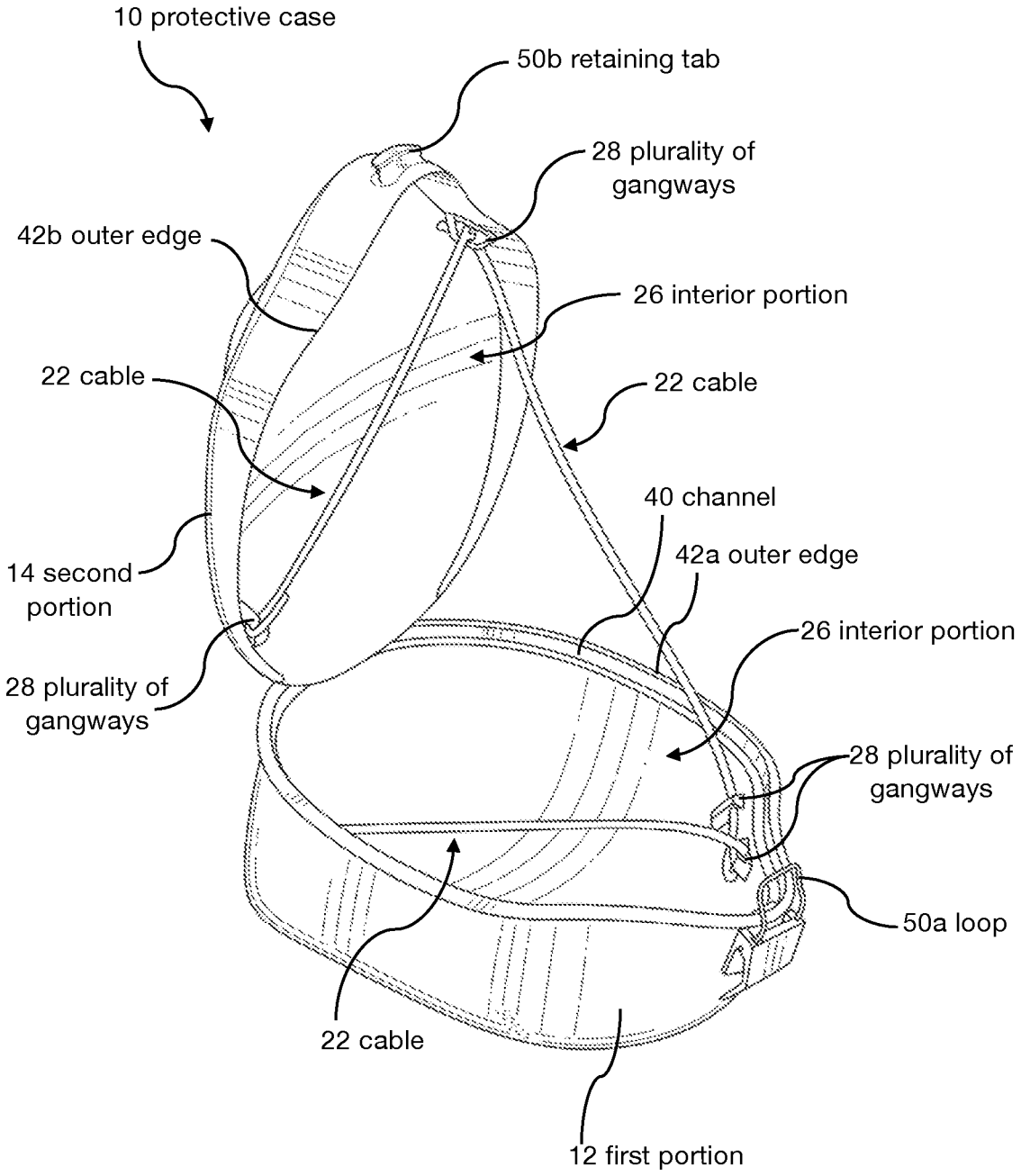
FIGS. 9 and 10 illustrate perspective views of an open protective case, according to some embodiments.
Figure 10:
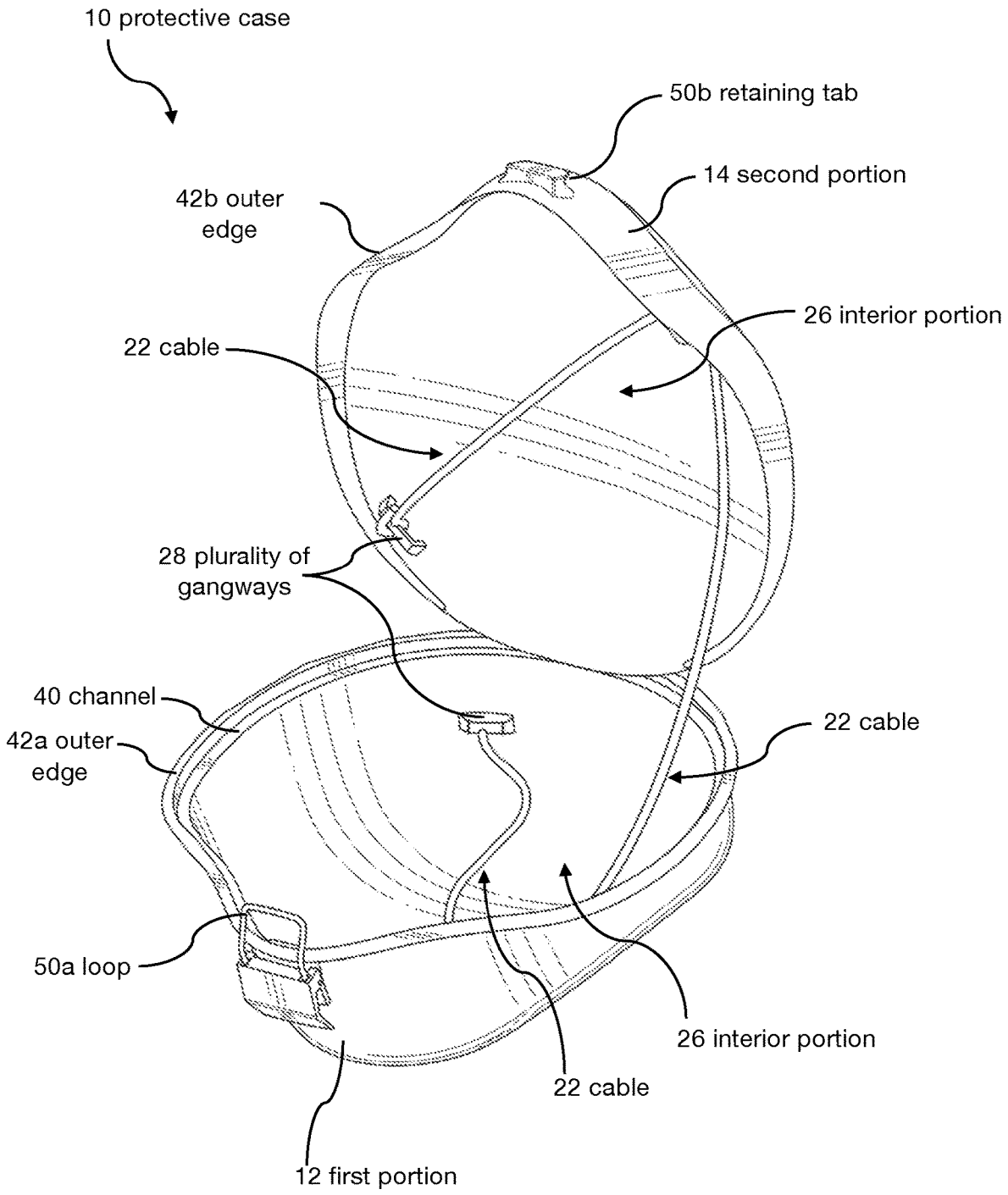

FIGS. 9 and 10 show perspective views of a protective case 10 in an open configuration, according to some embodiments. As illustrated, the protective case 10 may have a cable 22 that extends between the first portion 12 and the second portion 14. In some embodiments, the cable 22 is configured to retain at least one object within an interior portion 26 of the first portion 12 and/or the second portion 14. The cable 22 may also prevent the protective case 10 from "flopping" open upon disengagement of the loop 50*a* from the retaining tab 50*b*, by providing tension between the first portion 12 and the second portion 14. In some embodiments, the cable 22 is comprised of a stretchy material such as nylon, elastic, rubber, or the like. As demonstrated in FIGS. 9 and 10, the cable 22 may be configured to couple to and/or run through a plurality of gangways 28 located on the first portion 12 and the second portion 14, such that the plurality of gangways 28 couple the cable 22 to the first portion 12 and the second portion 14, the cable further being configured to limit rotation of the second portion about the hinge so as to limit separation between the first portion, at a farthest extent along the first portion from the first point, and the second portion, at a farthest extent along the second portion from the second point, to no more than ninety degrees. For example, the first portion 12 may include three gangways and the second portion 14 may include two gangways, for a total of five gangways in the protective case 10. It should be noted that any number of gangways in the plurality of gangways 28 may be suitable, and the number of gangways on the first portion 12 may be greater, less, or equal to the number of gangways on the second portion 14.

In some embodiments, the cable 22 is configured to knot, clamp, or the like around the first and last gangways in the plurality of gangways 28, and simply run through, without attaching to, the middle gangway(s) in the plurality of gangways 28. This may enable a user to more easily insert an object(s) in the first and/or second portions 12, 14 of the case 10, by providing more slack in the cable 22 such that the cable 22 is easily able to move and flex to allow insertion of an object(s). As shown in FIGS. 9 and 10, each gangway of the plurality of gangways 28 may be located along an inner edge of the first portion 12 and/or second portion 14 such that the plurality of gangways 28 are configured to not interfere with the placement of an object(s) within the interior portion 26 of the first portion 12 and/or second portion 14. The cable 22 may be configured to fold, upon closing of the protective case 10, such that substantially all of the cable 22 is located within the case 10 and not visible from outside the case 10, as demonstrated in FIGS. 1-8.

In some embodiments, the first portion 12 comprises a channel 40 located adjacent an outer edge 42*a* of the first portion 12, where the channel 40 is configured to receive an outer edge 42*b* of the second portion 14 to thereby form a seal between the first portion 12 and the second portion 14. The seal may be substantially waterproof. As the first portion 12 is configured to receive the second portion 14 via the channel 40, the channel 40 may be considered a female end of the channel 40 and the outer edge 42*b* of the second portion 14 may be considered a male end of the channel 40. In some embodiments, the outer edge 42*a* of the first portion 12 encircles the outer edge 42*b* of the second portion 14. The first portion 12 may include a raised perimeter configured to fit over and around the outer edge 42*b* of the second portion 14. The raised perimeter is visible in FIGS. 9 and 10, and also in FIGS. 5 and 6, in particular at the second point 20 in FIGS. 5 and 6. In some embodiments the channel 40 is located on the second portion 14, and is configured to receive the outer edge 42*a* of the first portion 12. The channel 40 may receive and hold the outer edge 42*b* via a friction fit.

Figure 11:
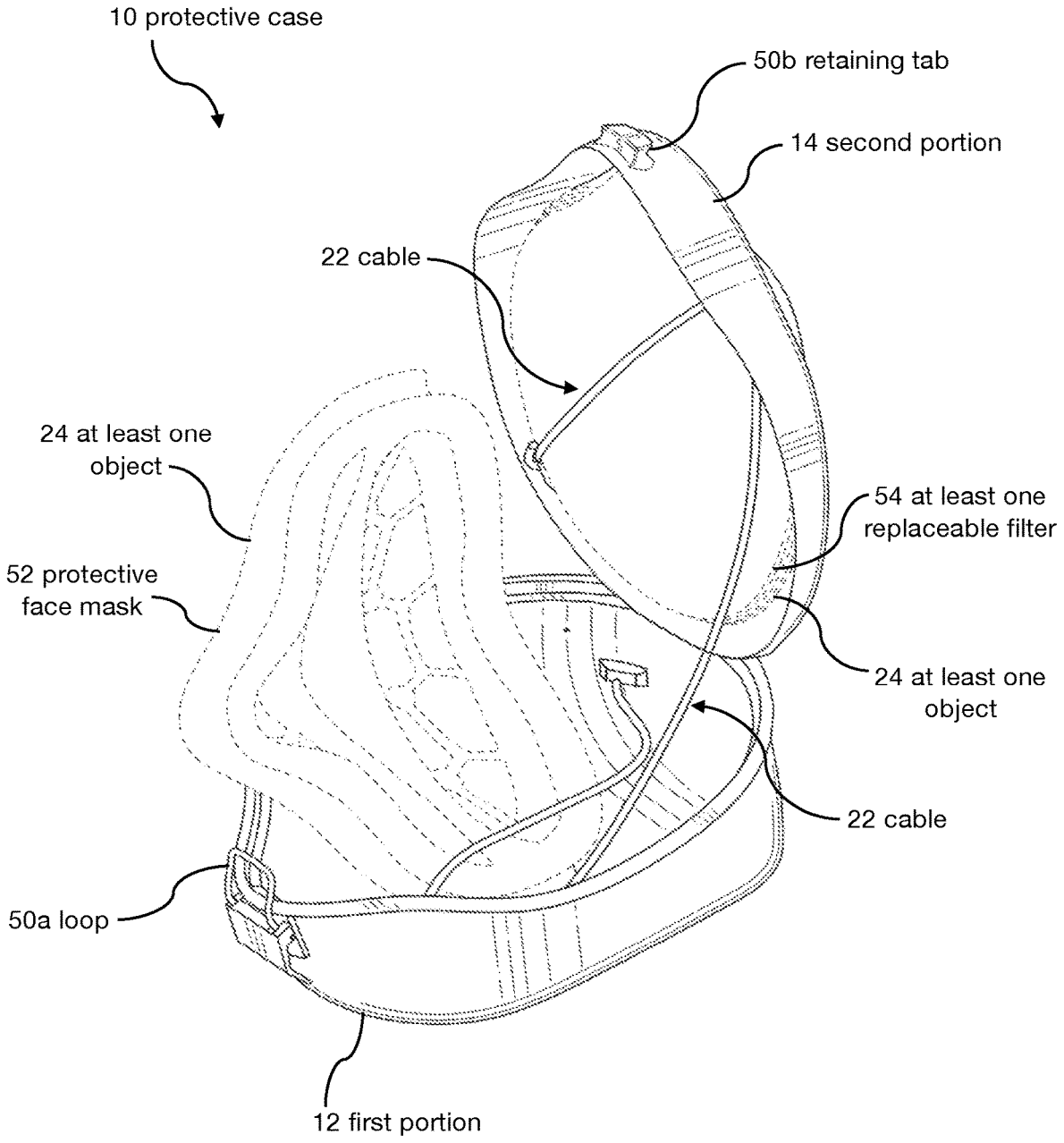
FIGS. 11 and 12 illustrate perspective views of an open protective case holding a face mask and at least one replaceable filter, according to some embodiments.
Figure 12:
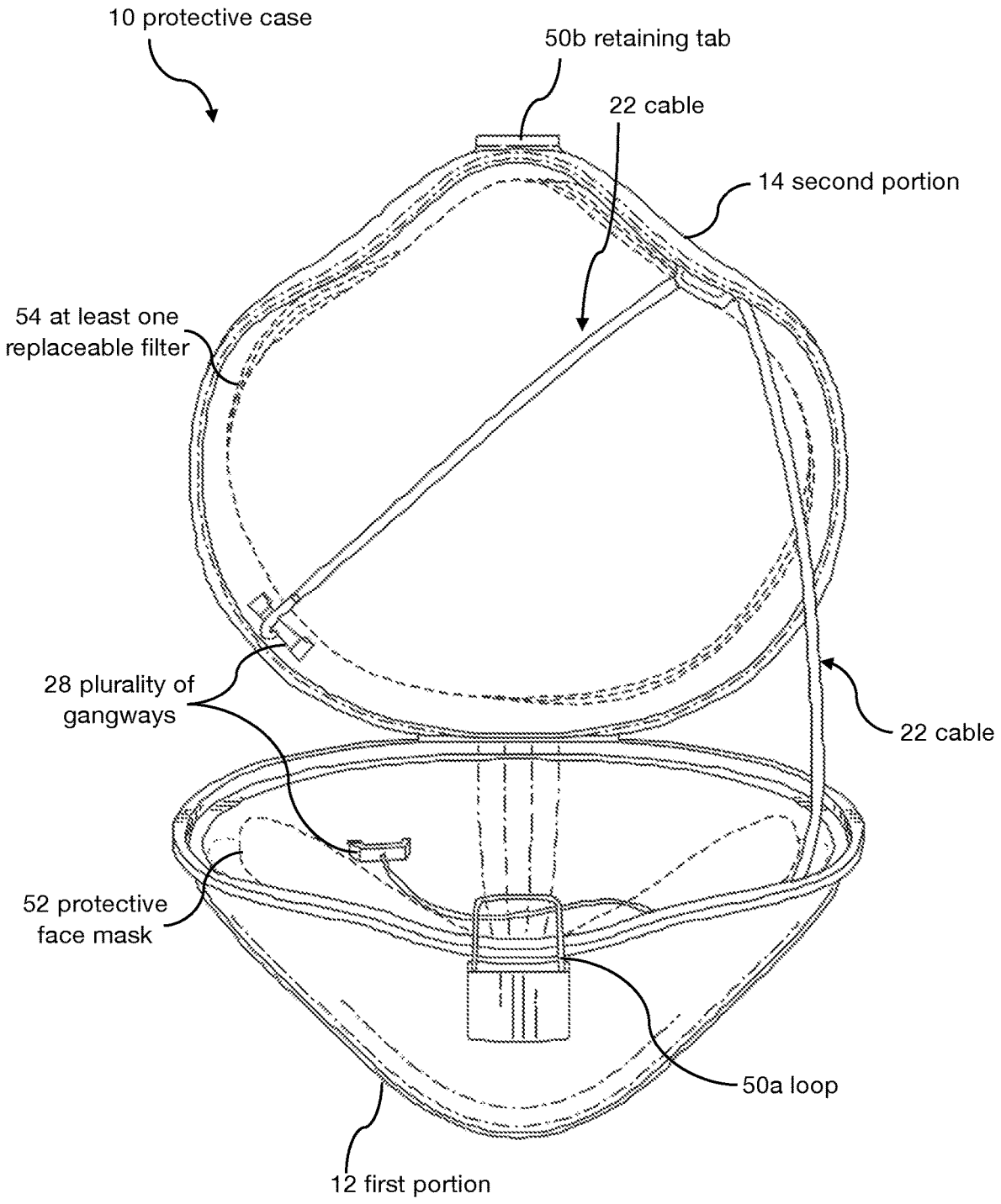

FIGS. 11 and 12 illustrate the protective case 10 holding at least one object 24, which, in many embodiments, is a protective face mask 52 and/or at least one replaceable filter 54. As shown in FIGS. 11 and 12, the first portion 12 may be sized and configured to retain the protective face mask 52 and the second portion 14 may be sized and configured to retain the at least one replaceable filter 54. In some embodiments, the at least one object 24 is configured to fit in an interior portion 26 of the first and/or second portion 12, 14, between the cable 22 and an interior surface of the interior portion 26 such that the cable retains the at least one object 24 within the first and/or second portion 12, 14, of the protective case 10. The cable 22 may run diagonally across the at least one object, as illustrated in FIGS. 11 and 12. In many embodiments, the cable 22 retains the at least one object 24 via tension. The flexibility of the cable 22 may allow the case 10 to hold objects of varying/irregular shapes and shapes, such as the protective face mask 52. The flexibility of the cable 22 may also allow the case 10 to accommodate a large amount of filters of the at least one replaceable filter 54. For example, the cable 22 may be configured to flex such that a single replaceable filter is retained within the second portion 14 just as effectively as twenty replaceable filters.

In many embodiments, the first portion 12 and the second portion 14 comprise an at least semi-flexible material, such as plastic. In some embodiments, the plastic is bisphenol A ("BPA") free for user safety. The first portion and second portion 12, 14 may comprise polypropylene ("PP") plastic. In many embodiments, the first portion and second portion 12, 14 comprise acrylonitrile butadiene styrene ("ABS") plastic. Whether comprising PP or ABS plastic, or a combination thereof, in some embodiments the material of the first portion and second portion 12, 14 includes embedded silver nanoparticles. In many embodiments, the integration of silver nanoparticles into the first portion and second portion 12, 14 imparts at least one of anti-bacterial, anti-viral, and anti-fungal properties to the protective case 10. In addition, the case 10 may be able to be washed, such as with warm water and soap, or rinsed, such as with rubbing alcohol, and re-used without breakdown of the material. In some embodiments, the cable 22 is also comprised of a material configured to impart at least one of anti-bacterial, anti-viral, and anti-fungal properties to the cable 22. Similar to the material of the first and second portions 12, 14, the material of the cable 22 may include embedded silver nanoparticles and may be able to be washed with soap and water and/or rinsed with rubbing alcohol.

Other elements of the protective case 10, such as the latching mechanism 18 and the hinge 48, may be comprised of a different material than the cable 22 and first and second portions 12, 14. For example, at least one of the latching mechanism 18 and the hinge 48 may be comprised of a metallic material, a different plastic material, or any other suitable material. The latching mechanism 18 and the hinge 48 may be comprised of the same material(s) or different material(s). In some embodiments, the material(s) that comprise the latching mechanism 18 and the hinge 48 are resistant to rust and/or other environment-related degradation. In some embodiments, the plurality of gangways 28 are comprised of the same silver nanoparticle-embedded plastic as the first portion and second portion 12, 14. The plurality of gangways 28 may be comprised of a different material(s) than the first portion and second portion 12, 14.

It should be noted that the protective case 10 may include a variety of elements not shown in the figures or previously described in the disclosure. For example, the case 10 may be available in a variety of colors and/or patterns. In some embodiments, customizability of the case 10 is available via a removable cover(s). The case 10 may also be painted or otherwise decorated. The protective case 10 may also include a battery pack configured to enable charging of external devices from the case 10. In such an embodiment, the case 10 may include at least one charging port.

In some embodiments, the protective case 10 is configured for self-cleaning. The case 10 may include at least one of an antiseptic spray and a UV light configured to sanitize at least one of an interior and exterior of the case 10. For example, the case 10 may include a small cartridge of antiseptic (or other sanitizing) spray located on an interior of the case 10 that is configured to discharge the sanitizing spray upon the press of a button. The sanitizing spray may also be activated upon the occurrence of at least partially closing and/or latching the case 10. In some embodiments, the button is located on an exterior of the case 10. The button may be a button on a mobile application communicatively coupled to the protective case 10 through Wi-Fi, Bluetooth, and/or other wireless connection. In some embodiments, the case 10 includes a power source configured to provide power to, and enable the operation of, the sanitizing spray cartridge and associated elements (e.g., power button).

In addition to or instead of the sanitizing spray, the case 10 may include a UV light configured to sanitize at least one of an interior and exterior of the case 10. In some embodiments, the UV light is located on an interior portion of the case 10 that is configured to activate upon at least one of the press of a button and at least partially closing and/or latching of the case 10. Similar to the antiseptic spray, the button for activating the UV light may be located on an exterior of the case 10. The button may also be a button on a mobile application communicatively coupled to the protective case 10 through Wi-Fi, Bluetooth, and/or other wireless connection. In an embodiment with both a sanitizing spray and a UV light, the cleaning options may share a button. There may be separate buttons for the sanitizing spray and the UV light. The case may include a power source configured to provide power to, and enable the operation of, the UV light and associated elements (e.g., the power button). The protective case 10 may have other additional elements, including different cleaning elements, than those shown in the figures and described in the disclosure.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

The term "substantially" is used to mean "completely", "nearly completely", "exactly", or "nearly exactly". For example, the disclosure includes "the belt clip 30 may have a length that is substantially the same length as the belt loop 38.". In this context, the term "substantially" indicates that the length of the belt clip is completely/exactly or nearly completely/exactly the same length as the belt loop.

The term "about" is used to mean "approximately". For example, the disclosure includes "the depth of the whole protective case 10 may be about 82 mm." In this context, the depth of the whole protective case is approximately 82 mm. A depth between 65 and 100 mm may fall into the range of "about 82 mm" in the context of this disclosure.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A protective case, comprising:

a first portion;

a hinge;

a second portion rotatably coupled about the hinge to the first portion at a first point;

a latching mechanism configured to detachably couple the first portion to the second portion at a second point located opposite the first point; and a cable connected to and between the first portion and the second portion, configured to retain at least one object within an interior portion of at least one of the first portion and the second portion, the cable further being configured to limit rotation of the second portion about the hinge so as to limit separation between the first portion, at a farthest extent along the first portion from the first point, and the second portion, at a farthest extent along the second portion from the second point, to no more than ninety degrees.

2. The protective case of claim 1, further comprising a plurality of gangways located on the interior portion of at least one of the first portion and the second portion, wherein the gangways are configured to couple the cable to at least one of the first portion and the second portion.

3. The protective case of claim 1, further comprising a belt clip located on a back portion of the second portion, wherein the belt clip is configured to receive at least one of a belt and a waistband to thereby enable a user to wear the protective case.

4. The protective case of claim 3, wherein the belt clip comprises a plurality of tooth-like projections located on an interior portion of the belt clip such that when the belt clip receives at least one of the belt and the waistband, the tooth-like projections are configured to contact a surface of the at least one of the belt and the waistband that is opposite a surface of the at least one of the belt and the waistband located adjacent the back portion of the second portion.

5. The protective case of claim 2, further comprising a belt loop located on a back portion of the second portion, wherein the belt loop is configured to receive a belt to thereby couple the protective case to the belt.

6. The protective case of claim 1, wherein the first portion comprises a channel located adjacent an outer edge of the first portion, the channel configured to receive an outer edge of the second portion.

7. The protective case of claim 6, wherein when the channel of the first portion receives the outer edge of the second portion, a seal is created between the first portion and the second portion.

8. The protective case of claim 7, wherein the seal comprises a seal that is substantially waterproof.

9. The protective case of claim 1, wherein at least one of the first portion and the second portion comprise a material configured to impart at least one of anti-bacterial, anti-viral, and anti-fungal properties to the protective case.

10. The protective case of claim 9, wherein the material comprises silver nanoparticles.

11. The protective case of claim 1, wherein the cable comprises a material that is configured to stretch.

12. The protective case of claim 11, wherein the cable further comprises a material configured to impart at least one of anti-bacterial, anti-viral, and anti-fungal properties to the cable.

13. The protective case of claim 12, wherein the material comprises silver nanoparticles.

14. The protective case of claim 1, wherein the first portion defines a first depth and the second portion defines a second depth, wherein the first depth is greater than the second depth.

15. The protective case of claim 14, wherein the second depth comprises a tapered depth such that a depth adjacent the first point is less than a depth adjacent the second point.

16. The protective case of claim 1, wherein the latching mechanism comprises a draw latch.

17. The protective case of claim 16, wherein the draw latch comprises a loop and a retaining tab, wherein the loop is coupled to the first portion and the retaining tab is coupled to the second portion.

18. The protective case of claim 1, wherein the at least one object comprises at least one of a protective face mask and at least one replaceable filter.

19. The protective case of claim 18, wherein the first portion is configured to retain the protective face mask and the second portion is configured to retain the at least one replaceable filter.

* * * * *